US006322246B1

(12) United States Patent
Leung

(10) Patent No.: US 6,322,246 B1
(45) **Date of Patent: *Nov. 27, 2001**

(54) WATER-RESISTANT MOVEMENT HOLDER FOR A POCKET WATCH

(75) Inventor: Dominic Y. F. Leung, Beaconsfield (CA)

(73) Assignee: Wing Root Limited, Hong Kong (HK)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/389,754

(22) Filed: Sep. 7, 1999

(51) Int. Cl.[7] ..... G04B 37/00; G04B 29/00
(52) U.S. Cl. ..... 368/299; 368/300
(58) Field of Search ..... 368/88, 276, 281, 368/288–292, 299–301, 306–309, 312–313, 319–321

(56) References Cited

U.S. PATENT DOCUMENTS

| | | | | |
|---|---|---|---|---|
| 780,287 | * | 1/1905 | Hardy . | |
| 3,638,418 | * | 2/1972 | Spadini . | |
| 3,640,065 | | 2/1972 | Lederrey et al. . | |
| 4,086,752 | * | 5/1978 | Kishimoto . | |
| 4,529,323 | * | 7/1985 | Gagnebin | 368/291 |
| 4,967,402 | * | 10/1990 | Claude | 368/280 |
| 5,943,302 | * | 8/1999 | Fanshaw | 368/276 |
| 6,056,432 | * | 5/2000 | Oehninger et al. | 368/281 |

FOREIGN PATENT DOCUMENTS

| | | |
|---|---|---|
| 84935 | 5/1920 | (FR) . |
| 376436 | 12/1963 | (FR) . |
| 2002836 | 10/1969 | (FR) . |
| 2254251 | of 1975 | (FR) . |

* cited by examiner

*Primary Examiner*—Vit Miska
(74) *Attorney, Agent, or Firm*—Merek & Voorhees

(57) ABSTRACT

A water-resistant movement holder for a pocket watch of the type that has a watch casing, comprised generally of a front and back portion that are joined or otherwise held together, a watch movement, a shaft, and a hinged cover portion. The movement holder comprises a primary housing and a mechanism to seal the primary housing within the watch casing. The primary housing has generally enclosed sides, an enclosed top and an open bottom with a generally hollow interior. The generally hollow interior is capable of releasably receiving the watch movement. The primary housing maintains the watch movement therein and limits the ingress of water, dirt and debris into the generally hollow interior and into contact with the watch movement.

8 Claims, 8 Drawing Sheets

WATER-RESISTANT MOVEMENT HOLDER FOR A POCKET WATCH

FIELD OF THE INVENTION

This invention relates to movement holders that retain and secure the internal working mechanisms of a watch or pocket watch within its casing, and in particular water-resistant movement holders for pocket watches having a hinged cover.

BACKGROUND OF THE INVENTION

Pocket watches are typically constructed with their internal working mechanisms or movements secured within a protective exterior casing to protect its internal components. The front surface of the casing is often fitted with a crystal, lens or other transparent material to allow for viewing of the watch's hands or digital display, as the case may be. Pocket watches also typically include a hinged and closable cover to protect their lenses or faces. Such covers are often held closed by a closing spring or latch mounted in the watch case. When open, the covers are usually maintained in an open position by means of a spring mounted along, or within, the hinge mechanism attaching the cover to the watch casing.

Many pocket watches share common watch movements that are manufactured by various suppliers and then purchased by watch manufacturers for use in individually styled watches. In some more expensive watches specific movements may be designed and manufactured for individual applications. In either case, a movement holder is often used to stabilize the watch movement and hold it securely within the exterior casing. The function of typical movement holders is to maintain the watch movement in its desired position, thereby preventing it from sliding or moving around within the case.

A problem that has been addressed by pocket watch manufacturers for a considerable length of time is the construction of a watch that is water and dust resistant. Water or dust that seeps into the watch casing can cause damage to the movement, thereby shortening the useful life span of the watch. Where the watch movement is electronic, water or dust coming into contact with critical electronic components can result in an immediate failure.

To inhibit the ingress of water and dust into the interior of a watch casing, others have developed a variety of different seals and sealing mechanisms used in association with the back of the casing. A rubberized or other synthetic seal may be placed upon the back such that when the back is fastened to the casing water and dust are prevented from entering into the interior of the watch. However, such seals suffer from a number of inherent limitations that can severely limit their effectiveness, particularly when the back of the watch is removed for purposes of cleaning or servicing, or to replace a battery in the case of an electrically powered watch. Often the seal on the back may be damaged or destroyed when servicing the movement. In other instances, if the back is not replaced in a precise manner upon the casing of the watch the seal may not fully engage the casing and a complete water tight and dust proof seal will not be achieved. In addition, such seals rarely provide any assistance in preventing water or debris from entering the watch casing through either the opening or closing spring used in association with a closable cover that may be used to protect the watch's crystal.

SUMMARY OF THE INVENTION

The invention therefore provides a water-resistant movement holder for a pocket watch that serves to maintain the watch's movement in a desired location while at the same time presenting a water and/or dust resistant barrier keeping water and dust from contaminating or otherwise damaging the internal mechanism of the movement.

Accordingly, in one of its aspects the invention provides a water-resistant movement holder for a pocket watch, said pocket watch being of the type generally having a watch casing, comprised generally of a front and back portion that are joined or otherwise held together, a watch movement, a shaft, and a hinged cover portion, the movement holder comprising a primary housing having generally enclosed sides, an enclosed top and an open bottom with a generally hollow interior, said generally hollow interior capable of releasably receiving therein the movement of the watch; and, means to seal said primary housing within the watch casing such that said primary housing maintains the watch movement therein and limits the ingress of water, dirt and debris into said generally hollow interior and into contact with the watch movement.

Further objects and advantages of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which.

DESCRIPTION OF THE PREFERRED EMBODIMENT

The present invention may be embodied in a number of different forms. However, the specification and drawings that follow describe and disclose only some of the specific forms of the invention and are not intended to limit the scope of the invention as defined in the claims that follow herein.

Figure 1:
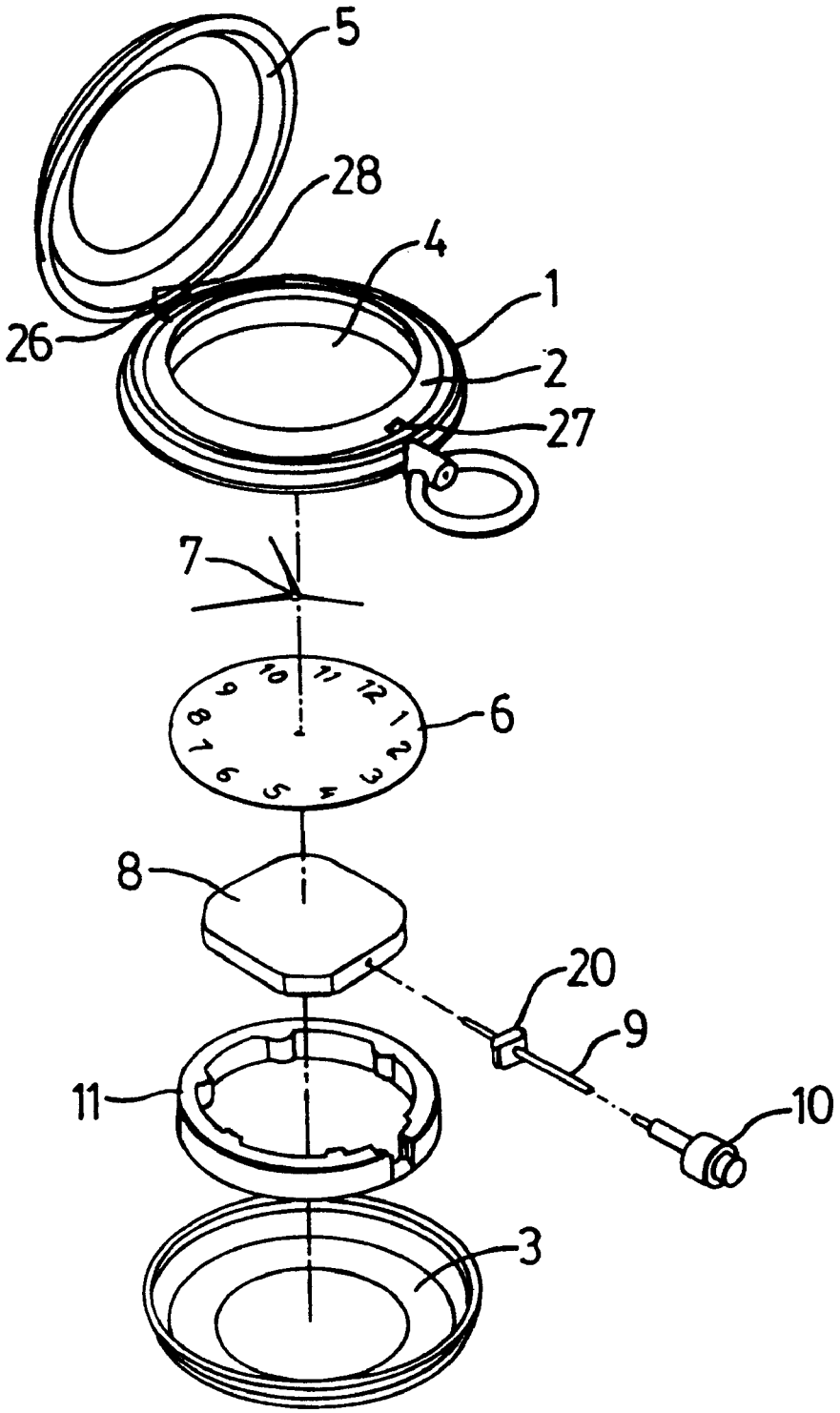
FIG. 1 is an exploded view of the primary component parts of a pocket watch employing the water-resistant movement holder of the present invention.

Referring to FIG. 1, there is shown an exploded view of the primary components of a pocket watch that employs the water-resistant movement holder of the present invention. In the Figure the watch comprises an outer watch housing or casing 1 having a front portion 2 and a back portion 3. Typically back portion 3 is comprised of a solid, rigid, plastic or metal material in order to protect internal components of the watch. Upper portion 2 is commonly fitted with a centrally located crystal or transparent window portion 4.

Upper portion 1 also includes an outer cover 5 that may be closed around crystal or window portion 4 in order to protect it from damage. Cover 5 is typically attached to casing 1 by means of a hinge 26. Through operation of hinge 26 cover 5 may be rotated from a closed position, wherein it encloses and protects crystal or window portion 4, to an open position (see FIG. 1) wherein access is provided to the crystal. To maintain cover 5 in its closed position casing 12 typically includes a closing spring or catch 27 that engages the interior surface of the cover. Opening the cover requires the application of sufficient force to dislodge closing spring or catch 27. Once closing spring or catch 27 has been disengaged from the interior surface of the cover, an opening spring 28 assists in moving the cover to its open position and maintaining it in that location. In most instances opening spring 28 is adjacent to, or incorporated within, hinge 26.

The remaining primary components of the watch that are shown in FIG. 1 include a face or dial 6, a set of hands 7, and an internal working mechanism or movement 8. In most instances movement 8 will include an outwardly extending shaft 9, typically having mounted thereon a crown 10. Shaft 9 allows for adjusting the time displayed on the watch or, in the case of a manually powered watch, provides a mechanism to wind the watch's internal spring.

According to the present invention there is further provided a water-resistant movement holder 11. Movement holder 11 is comprised generally of a primary housing 12, having generally enclosed sides 13, an enclosed top 14, and an open bottom 15. Sides 13, enclosed top 14, and open bottom 15 together define a generally hollow interior 16 within which movement 8 may be received and releasably secured. Preferably movement holder 11 is comprised of plastic, metal or a similar material.

Figure 3:
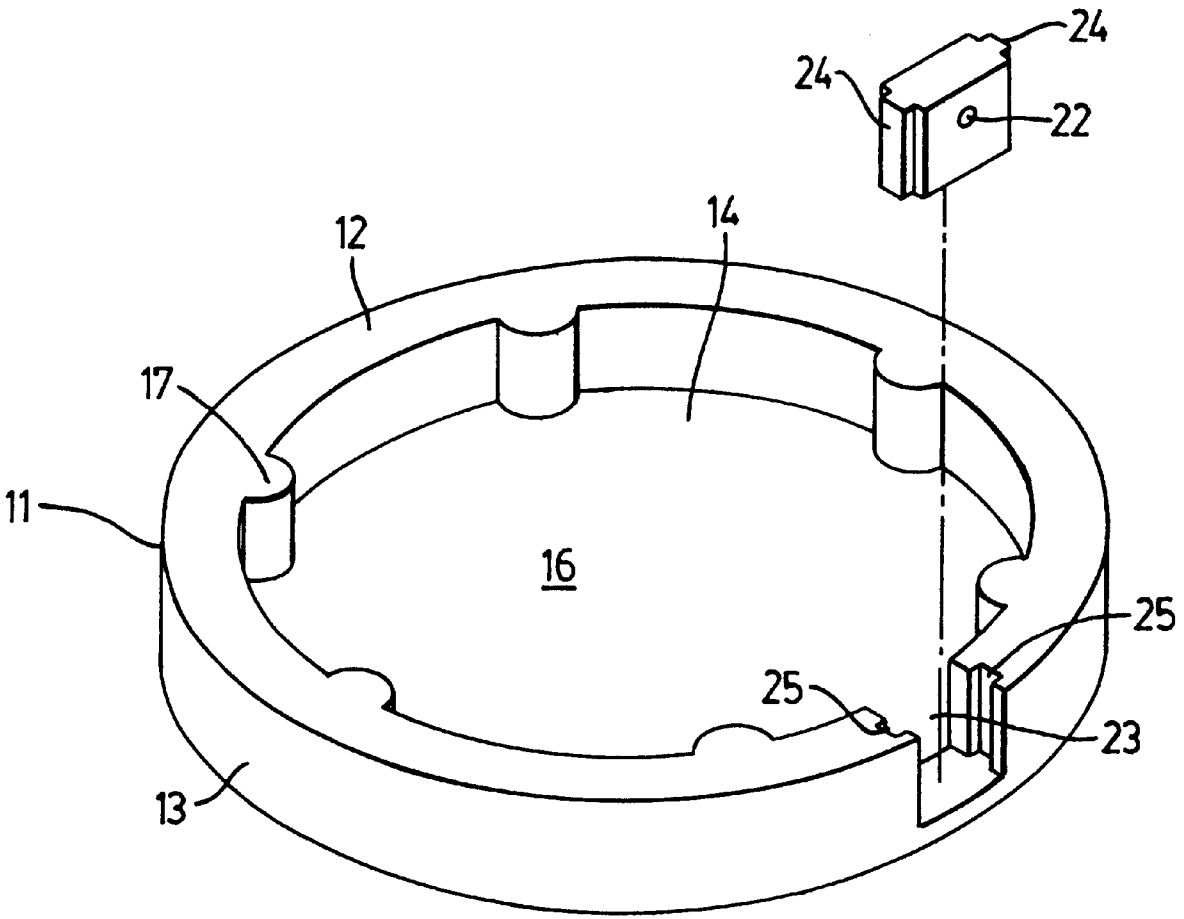
FIG. 3 is an upper side perspective and exploded view of the water-resistant movement holder pursuant to the present invention.
Figure 4:
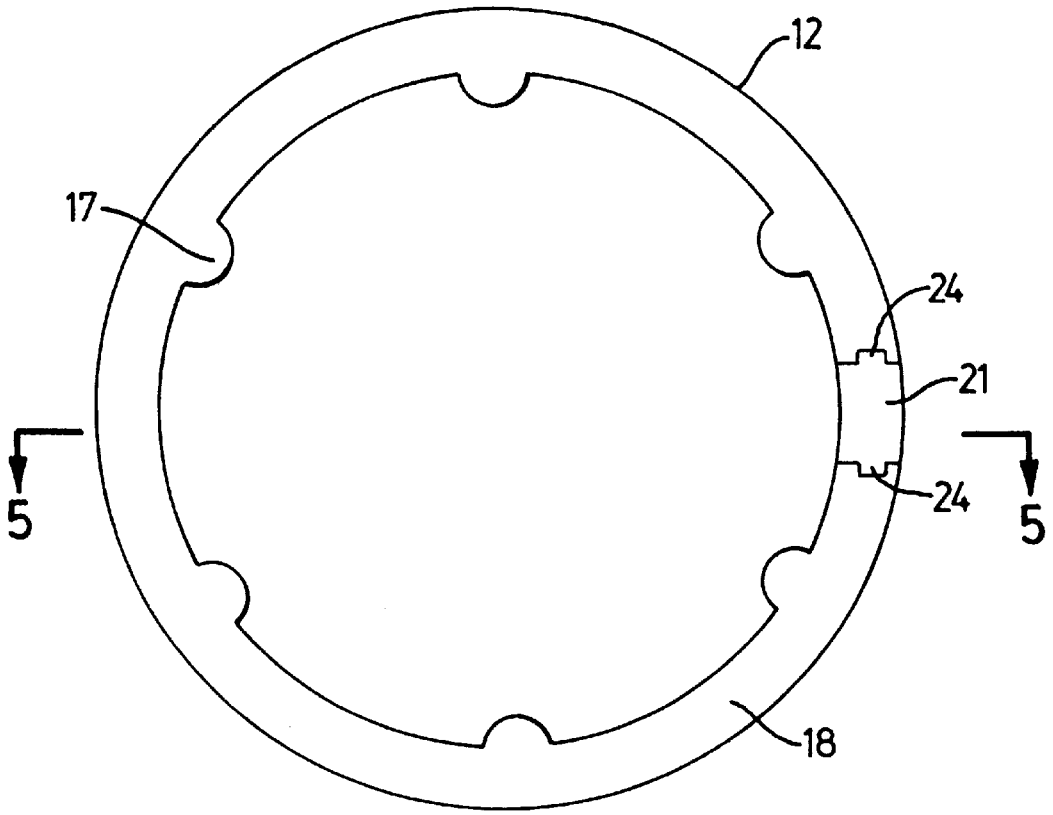
FIG. 4 is a bottom view of the water resistant-movement holder pursuant to the present invention
Figure 5:
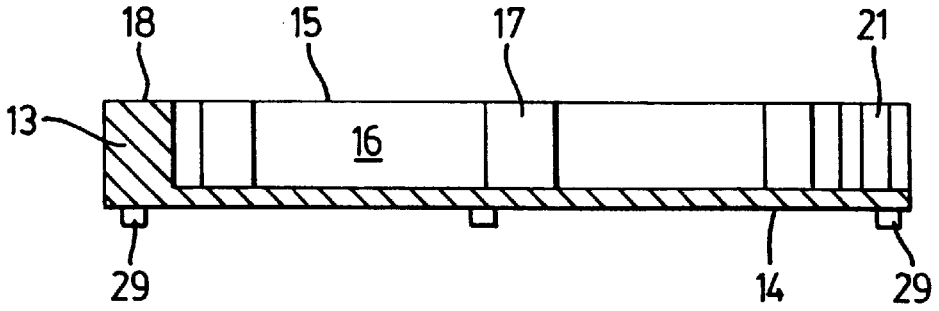
FIG. 5 is a sectional view taken along the line 5—5 of FIG. 4.

As shown in FIGS. 1 and 3, in the preferred embodiment movement holder 11 is of a generally cylindrical shape such that it may be readily received within watch casing 1. However, it will be appreciated by those skilled in the art that depending upon the particular shape and configuration of the watch casing, movement holder 11 could take a variety of other shapes while still remaining within the broad scope of the invention. For example, if desired, movement holder 11 could have a rectangular or octagonal shape and may be received within the correspondingly shaped interior of casing 1.

With the modern trend of making watch movements as small as possible in order to create small, thin and lightweight watches and pocket watches, in most instances movement holder 11 will be of a relatively thin stature. In most applications enclosed sides 13 will extend beyond enclosed top 14 only to a sufficient degree to allow for the complete receipt of movement 8 within hollow interior 16. To help maintain movement 8 securely within hollow interior 16, in the preferred embodiment the interior surfaces of enclosed sides 13 may include a series of inwardly projecting rib members 17 that contact movement 8 and help prevent rotation and sliding of the movement within hollow interior 16.

The movement holder pursuant to the present invention further includes means to seal primary housing 11 within watch casing 1, such that when sealed and retained within the watch casing the primary housing not only stabilizes and securely holds movement 8 in place, but also limits the ingress of water, dirt and other debris into hollow interior 16. It will, of course, be appreciated that sealing movement holder 8 within watch casing 1 may be accomplished in a variety of different manners. In the preferred embodiment the seal is formed by way of the utilization of a smooth bottom surface 18 on enclosed sides 13 of primary housing 12, in conjunction with a correspondingly smooth surface 19 on the interior of front portion 2 of watch casing 1. Where dial 6 is of sufficient size, the seal will be formed between surface 18 and the rear surface 30 of dial 6.

Figure 2:
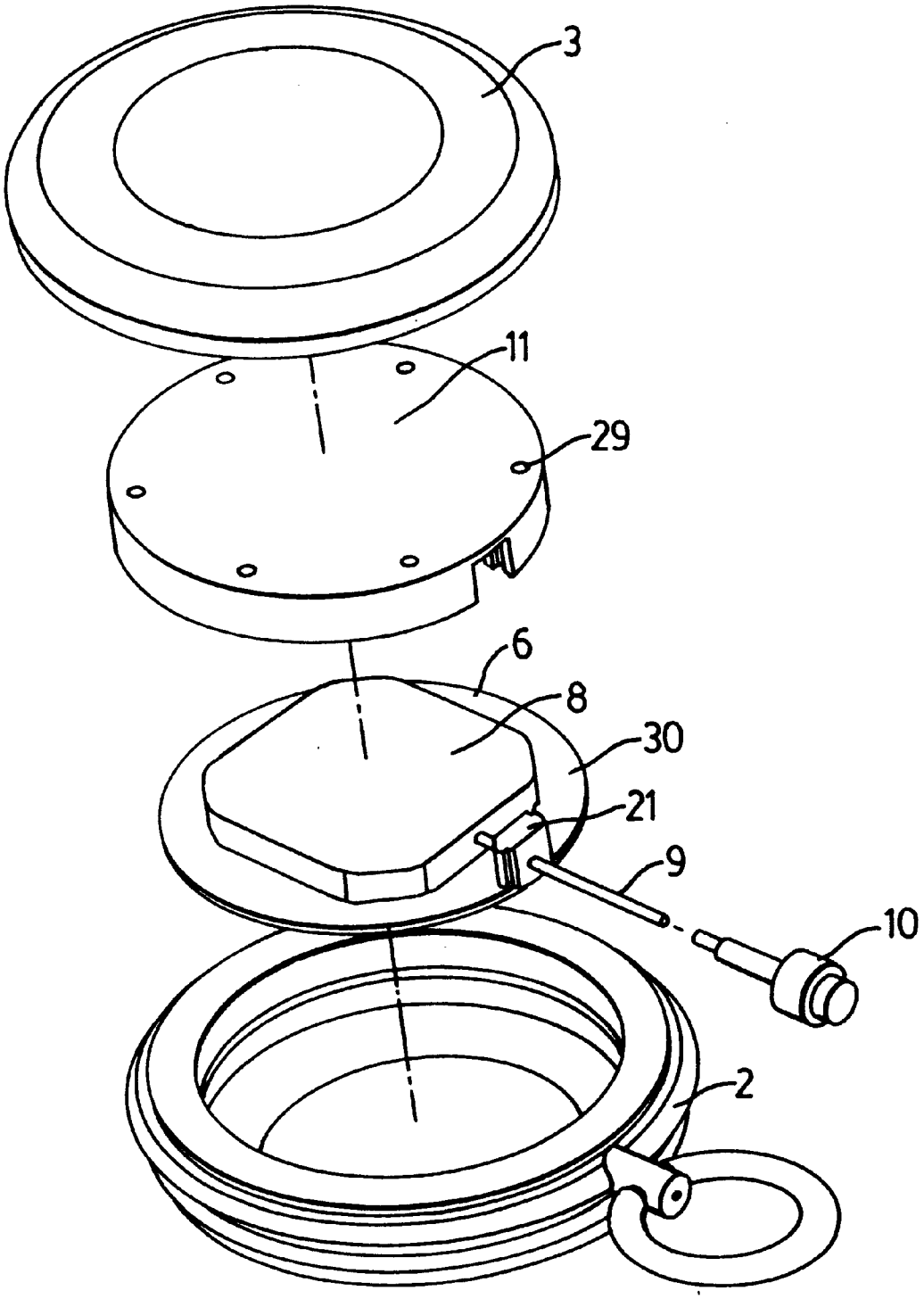
FIG. 2 is an exploded view of a pocket watch having its rear cover removed showing the manner of assembly utilizing the water-resistant movement holder of the present invention.
Figure 6:
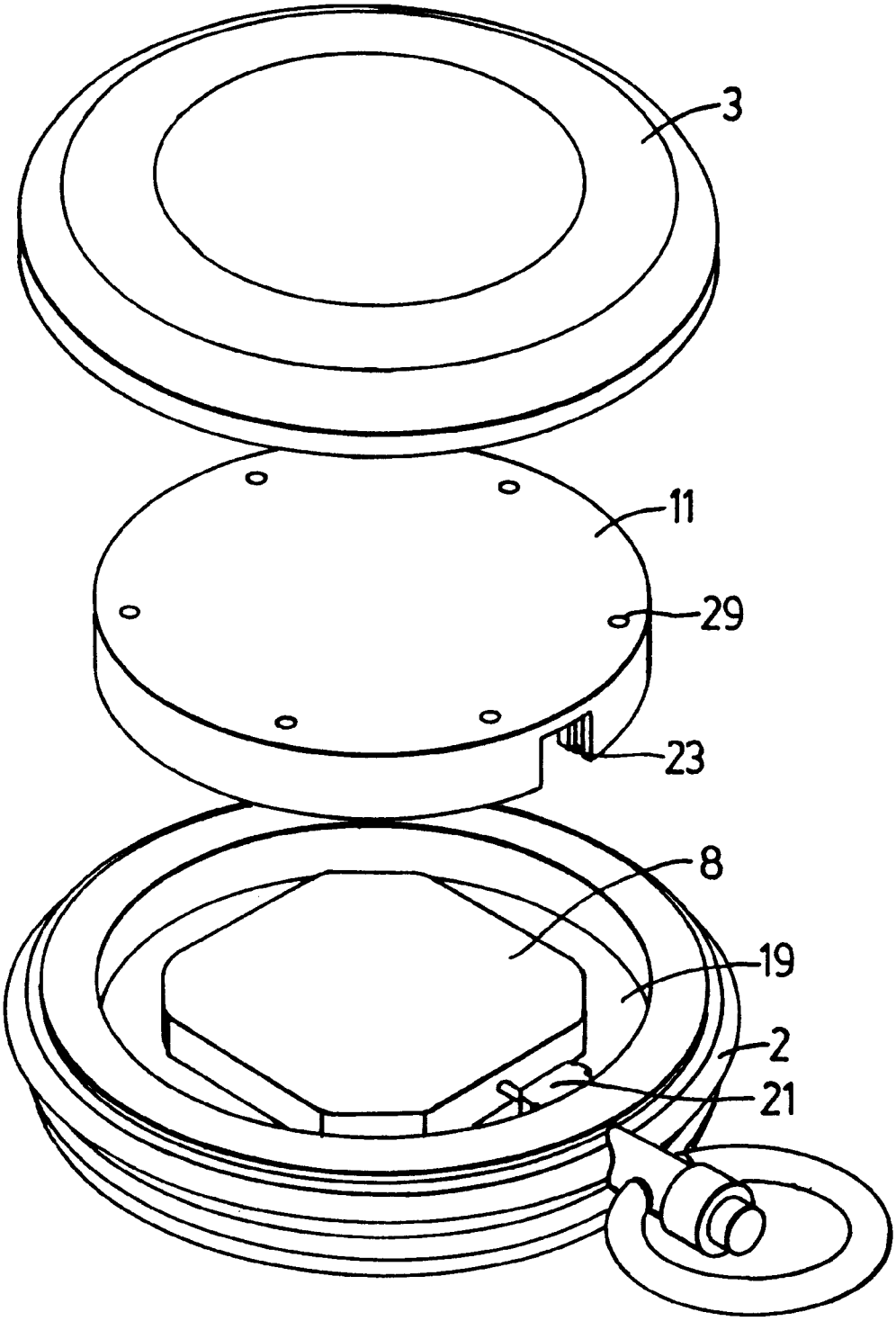
FIG. 6 is an exploded view of a pocket watch having its rear cover removed showing the manner of insertion of the water-resistant movement holder of the present invention.

With specific reference to FIGS. 1, 2 and 6, it will be understood that when the pocket watch is assembled with movement 8 received and secured within movement holder 11, compressing surface 18 against surface 19 will create a seal therebetween, preventing the ingress of water or debris into hollow interior 16. In a preferred embodiment sides 13 of movement holder 11 are constructed so that primary housing 12 is of a sufficient depth to ensure that a tight compressing force is applied between surfaces 18 and 19 when front portion 2 and back portion 3 of the casing are fastened together. In a further preferred embodiment, enclosed top 14 of primary housing 12 includes a series of upwardly extending legs 29. Legs 29 are designed to engage the interior surface of back portion 3 when the watch is assembled. In this manner compressive force may be transferred through legs 29 to primary housing 12 to ensure a tight seal between surfaces 18 and 19. Legs 29 can be constructed such that they can easily be cut or ground to a desired length, as required for individual watch configurations. For example, legs 29 can be cut to different lengths to accommodate an irregularly shaped back portion.

Where movement 8 includes a shaft 9, movement holder 11 will further include shaft sealing means 20 to seal about the shaft and prevent the ingress of water, dirt and debris into hollow interior 16 along the length of the shaft. As shown most clearly in FIGS. 2 and 3, in the preferred embodiment shaft sealing means 20 comprises a flexibly resilient shaft seal 21 that is securable over shaft 9, and that may be received within enclosed sides 13 of primary housing 12. Once again, it will be appreciated by those skilled in the art that a wide variety of different shaft seals could be utilized while still remaining within the broad scope of the invention. In the preferred embodiment, and as shown in the attached drawings, shaft seal 21 is comprised of a rubber, plastic or silicone seal having a bore 22 through which shaft 9 can pass. Bore 22 is constructed to be of a slightly smaller diameter than that of shaft 9. The size of bore 22 and the flexibly resilient nature of shaft seal 21 helps to ensure a tight fit of the seal about the shaft. To further reduce the possibility of liquid or debris entering hollow interior 16 along the length of shaft 9, bore 22 may also include one or more internal O-rings that seal against the shaft.

Shaft seal 21 is received within enclosed sides 13 of primary housing 12 through the formation of a slot 23 that is of a general shape and size corresponding to that of the shaft seal. As shown in FIG. 3, shaft seal 21 may be a generally rectangular shape having an outwardly extending rib 24 along each end. Slot 23 is preferably of a similar configuration having a channel 25 that is of a shape corresponding to rib 24, along each end. Through sliding shaft seal 21 into slot 23 such that ribs 24 are received within channels 25, the shaft seal may be received and securely held within the side of primary housing 12. This manner of securing the shaft seal in the side of the primary housing not only maintains the seal in place but also adds enhanced lateral stability to the seal. Lateral stability is particularly useful in instances where the watch shaft may be extended or retracted in a radial direction in order to set the time or perform other functions.

To help ensure that water, dirt and other debris is prevented from passing into hollow interior 16 through slot 23 or around shaft seal 21, the seal may be constructed such that it is slightly larger in size than slot 23. In this manner a slight compression of the flexibly resilient seal will be necessary in order to insert it into slot 23. However, once inserted, the resiliency of the compressed seal will further enhance the bond between the seal and primary housing 12. Further, seal 21 may also be constructed with a height slightly exceeding that of enclosed sides 13 such that the seal will be compressed against surface 19 when the watch components are assembled.

The above described structure provides a means to both secure and stabilize a watch movement within the interior of a watch casing, while also helping to protect the watch movement from contact with of any water, dirt or other debris that may penetrate the casing. Movement holder 11 is particularly useful for protecting the watch movement from damage due to water and debris that may enter the casing around closing spring 27 or opening spring 28. The particular structure of primary housing 12 and shaft seal 21 are such that they allow for both sealing the movement holder within the watch casing while at the same time presenting the ability to easily access the movement holder for purposes of cleaning, maintenance, changing batteries, etc. For example, as shown in FIG. 2, with shaft seal 21 secured about shaft 9, movement 8 may be placed within watch casing 1 with primary housing 12 later being placed over the movement such that seal 21 is received within slot 23. Thereafter the back portion 3 of the watch casing can be secured to front portion 2 completing the assembly process. As described previously, the assembled watch ensures that adequate pressure is applied between contacting surfaces 18 and 19 to form an effective seal therebetween.

In the event that access to movement 8 is required for any reason, back portion 3 of the casing must first be removed, after which primary housing 12 can merely be lifted out from the casing with movement 8, shaft 9 and shaft seal 21 remaining fixed in place. Full access to the movement (and battery if any) is then provided. When any necessary servicing has been completed primary housing 12 can merely be inserted back into casing 1, with slot 23 again received around shaft seal 21. Movement holder 11 will then once again present a structure that stabilizes and securely holds the watch movement in place while helping to prevent movement 8 from coming into contact with water, dirt or other debris that may enter the watch casing.

Figure 7:
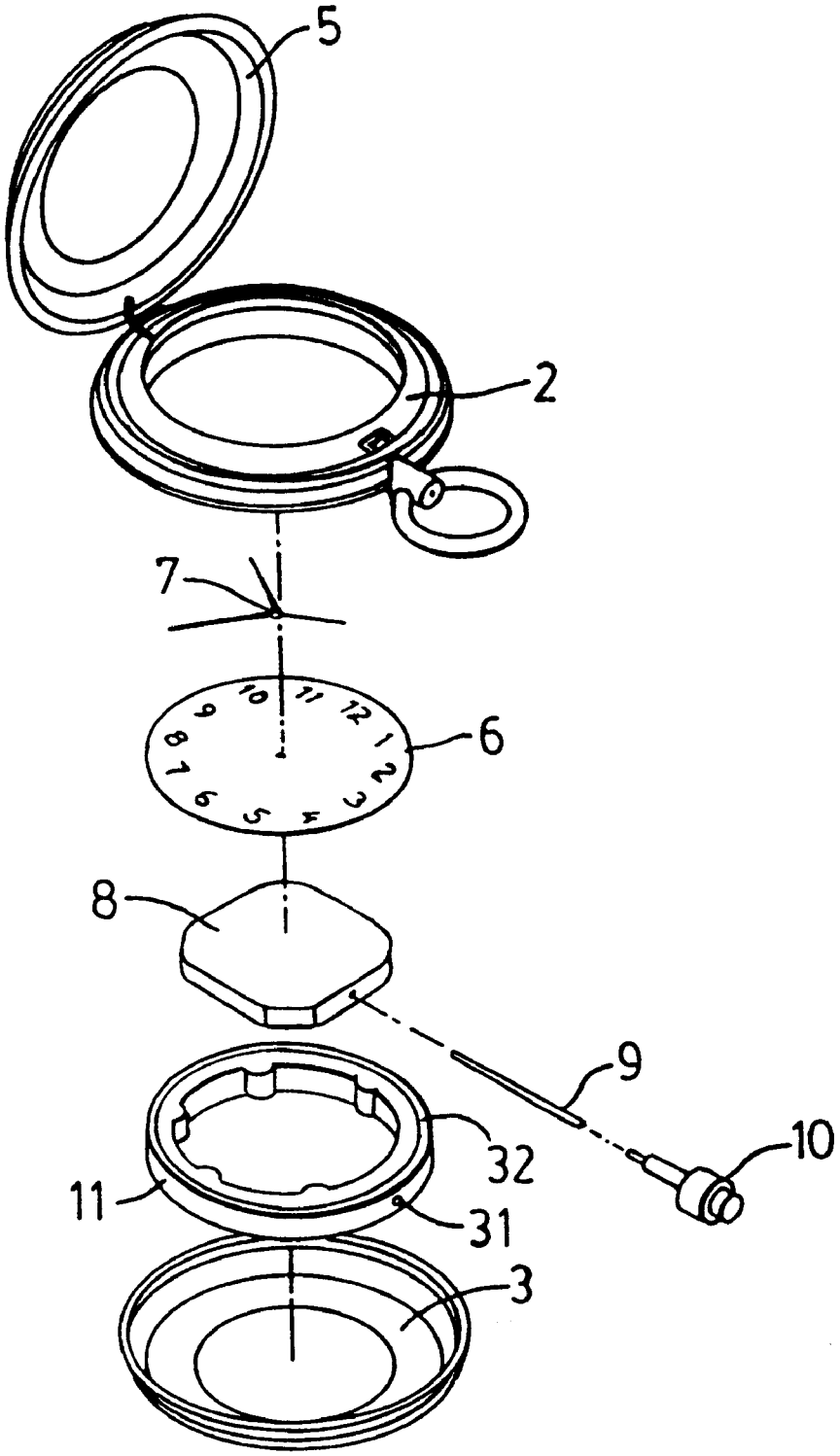
FIG. 7 is an exploded view of a pocket watch employing an alternate embodiment of the water-resistant movement holder of the present invention.
Figure 8:
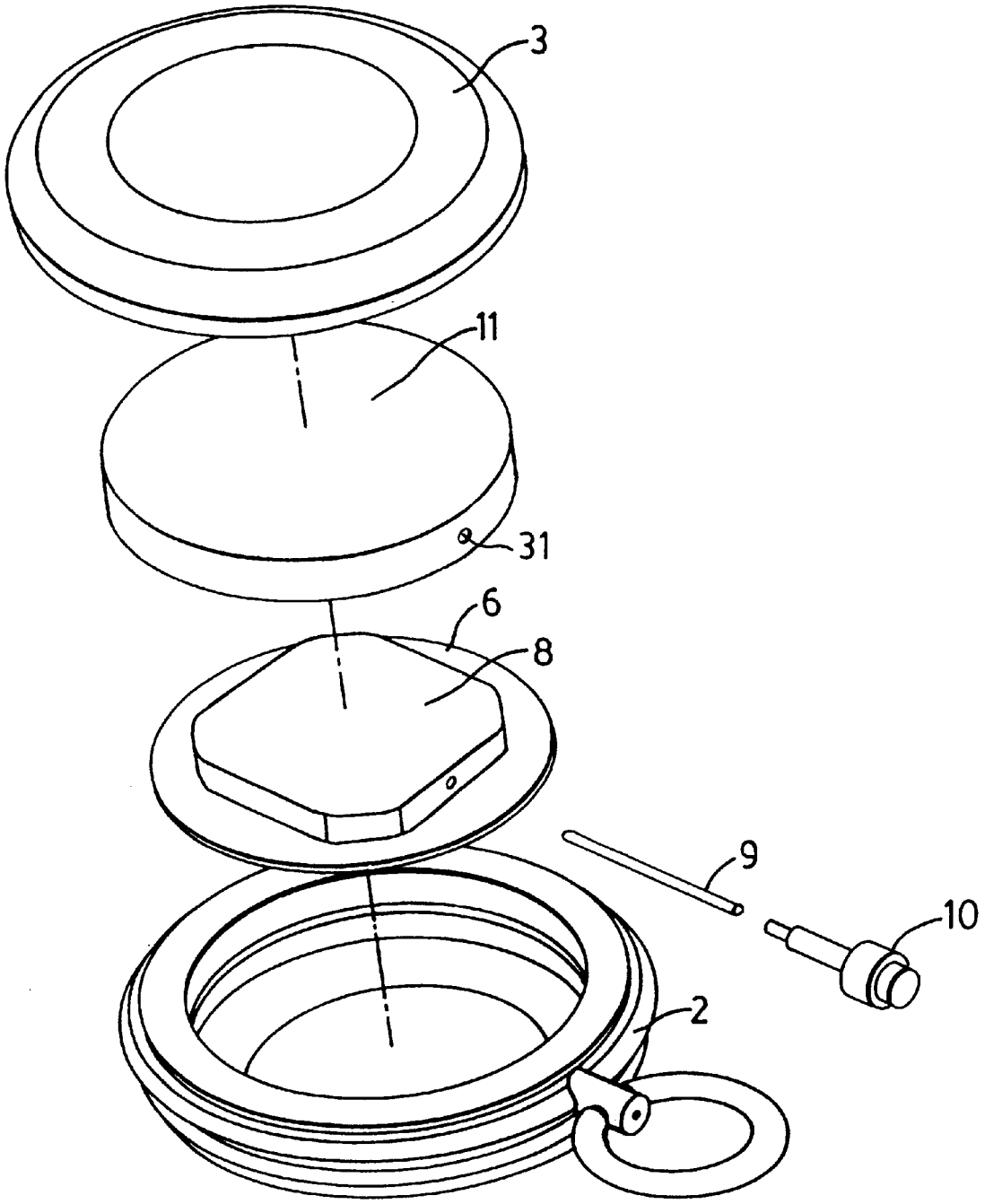
FIG. 8 is an exploded view of a pocket watch having its rear cover removed showing the water-resistant movement holder of FIG. 7; and, FIG. 9 is an upper side perspective view of the water-resistant movement holder pursuant to the embodiment of FIG. 7.
Figure 9:
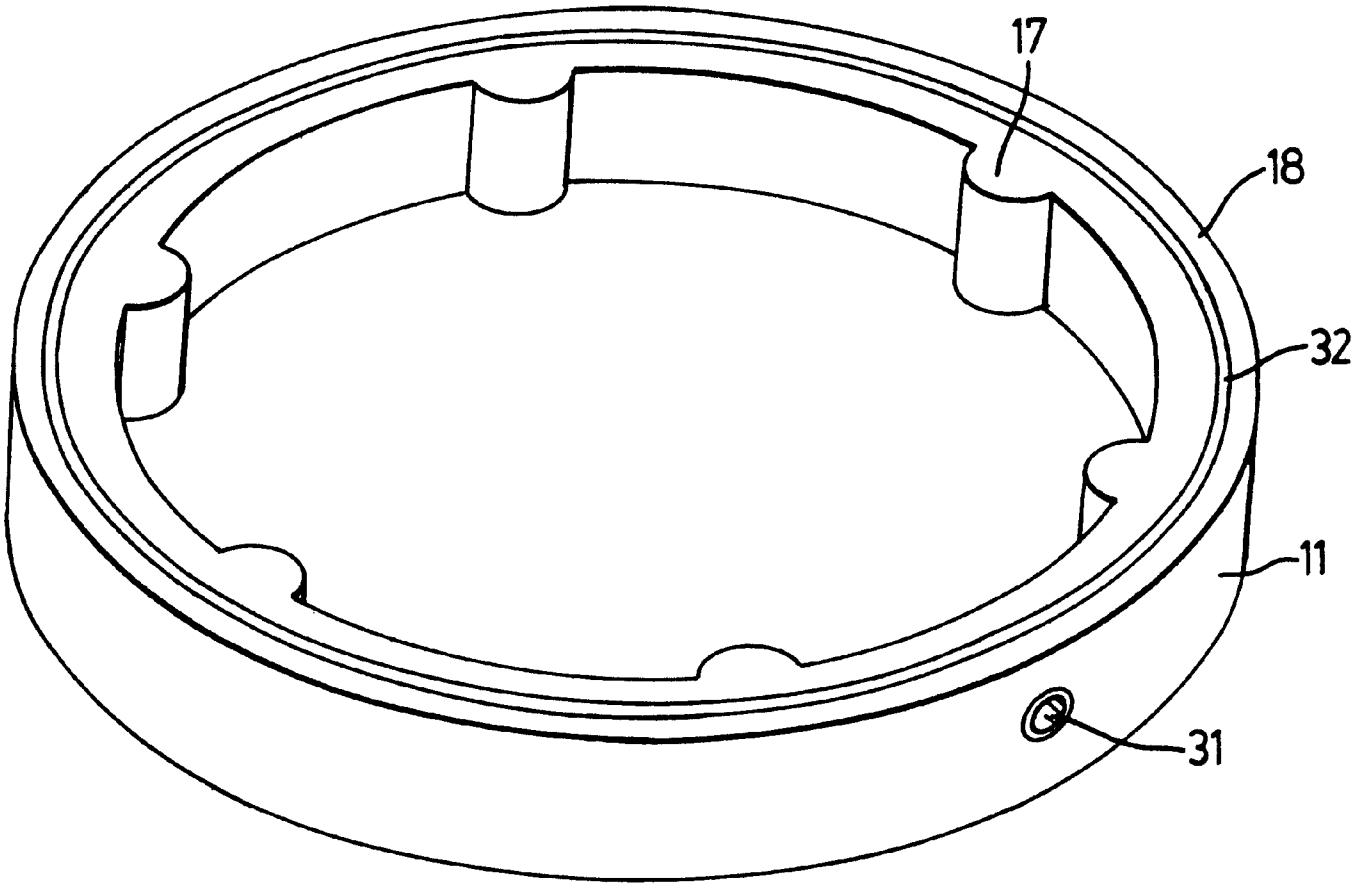

An alternate embodiment of the water-resistant movement holder of the present invention is shown in FIGS. 7 through 9. In this embodiment enclosed sides 13 of movement holder 11 include a generally circular opening 31 therethrough. Opening 31 is designed to receive shaft 9 and allow the shaft to pass through the sides of the movement holder. Preferably one or more 0-rings are situated within opening 31 to provide a seal against the exterior of the shaft. As shown in FIGS. 7 and 9, to enhance the seal between surface 18 of primary housing 12 and surface 19 of watch casing 1, an O-ring 32 may be inserted into a circular channel upon surface 18. When the pocket watch is assembled O-ring 32 bears against surface 19 of the watch casing to create an enhanced water-resistant seal. It will, of course, be appreciated that while O-ring 32 does not appear in the embodiment shown in FIGS. 1 through 6, it could also be incorporated into that embodiment to enhance the water-resisting capabilities of movement holder 11.

It is to be understood that what has been described are the preferred embodiments of the invention and that it may be possible to make variations to these embodiments while staying within the broad scope of the invention. Some of these variations have been discussed while others will be readily apparent to those skilled in the art.

I claim:

1. A water-resistant movement holder for a pocket watch, said pocket watch being generally of the type having a watch casing, comprised generally of a front and back portion that are joined or otherwise held together, a watch movement, a shaft, and a hinged cover portion, the movement holder comprising, (i) a primary housing having generally enclosed sides, an enclosed top and an open bottom with a generally hollow interior, said generally hollow interior capable of releasably receiving therein the movement of the watch; and, (ii) means to seal said primary housing within the watch casing such that said primary housing maintains the watch movement therein and limits the ingress of water, dirt and debris into said generally hollow interior and into contact with the watch movement.

2. The device as claimed in claim 1 including shaft sealing means to seal about the shaft of the watch movement and prevent the ingress of water, dirt and debris into said hollow interior along the shaft.

3. The device as claimed in claim 2 wherein said shaft sealing means comprises a flexibly resilient shaft seal releasably securable over the watch shaft and releasably receivable in a seal retaining opening in said enclosed sides of said primary housing.

4. The device as claimed in claim 3 wherein said means to seal said primary housing within the watch casing comprises a smooth bottom surface on said enclosed side surfaces of said primary housing, said smooth bottom surface engaging a correspondingly smooth surface on the interior of the watch casing and forming a seal therebetween when said primary housing is compressed against the interior surface of the watch casing.

5. The device as claimed in claim 4 wherein said enclosed top of said primary housing includes a plurality of upwardly extending legs, said legs engaging the interior of the back portion of the watch casing when the watch is assembled and thereby compressing said smooth bottom surface of said primary housing against said smooth surface on the interior of the watch casing.

6. The device as claimed in claim 5 including internal watch movement holding ribs positioned along the interior surface of said enclosed sides of said primary housing, said ribs helping to stabilize the watch movement within said generally hollow interior of said primary housing.

7. The device as claimed in claim 6 wherein said primary housing is molded from a water-resistant plastic material.

8. The device as claimed in claim 2 wherein said shaft sealing means comprises a generally circular opening through said enclosed sides of said primary housing, said generally circular opening receiving the watch's shaft therethrough and searingly engaging the shaft.

* * * * *